US006139205A

United States Patent [19]

Suzuki et al.

[11] Patent Number: 6,139,205

[45] **Date of Patent: *Oct. 31, 2000**

[54] SERIAL PRINTER WHICH PROVIDES ACCELERATION CONTROL OF CARRIER

[75] Inventors: Hisao Suzuki; Hiromoto Ishii; Akira Oda; Eiichi Furuya, all of Mishima, Japan

[73] Assignee: Toshiba Tec Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/261,332

[22] Filed: Mar. 3, 1999

[30] Foreign Application Priority Data

Mar. 9, 1998 [JP] Japan ..... 10-056458
Dec. 17, 1998 [JP] Japan ..... 10-359038

[51] Int. Cl.[7] ..... B41J 11/44

[52] U.S. Cl. ..... 400/76; 400/279; 400/283; 400/70; 400/61

[58] Field of Search ..... 400/279, 76, 70, 400/61, 283

[56] References Cited

U.S. PATENT DOCUMENTS 4,457,639 7/1984 Nagai .
4,869,610 9/1989 Nishizawa et al. .
5,207,520 5/1993 Tanaka ..... 400/279
5,368,402 11/1994 Takahashi et al. ..... 400/279
5,547,295 8/1996 Kanemitsu ..... 400/279
5,547,296 8/1996 Iwazawa ..... 400/322
5,690,440 11/1997 Konishi ..... 400/279
5,871,291 2/1999 Kawazoe ..... 400/279
5,873,663 2/1999 Yokoi et al. ..... 400/279

FOREIGN PATENT DOCUMENTS 0 634 279 A2 1/1995 European Pat. Off. .
41 07 036 A1 9/1991 Germany .
62-173262 7/1987 Japan .

*Primary Examiner*—John S. Hilten
*Assistant Examiner*—Charles H. Nolan, Jr.
*Attorney, Agent, or Firm*—Frishauf, Holtz, Goodman, Langer & Chick, P.C.

[57] ABSTRACT

A serial printer apparatus comprises a print heat for printing on a medium according to a received character signal, a carrier on which the print head is provided and which runs the print head over an unprintable region and a printable region, and a control circuit for monitoring the running speed of the carrier and controlling the speed of the carrier by accelerating or decelerating the carrier while suppressing the amount of fluctuation of the speed at least in the printable region.

8 Claims, 15 Drawing Sheets

SERIAL PRINTER WHICH PROVIDES ACCELERATION CONTROL OF CARRIER

BACKGROUND OF THE INVENTION

This invention relates to a serial printer which prints while moving a carrier provided with a print head.

In this type of serial printer, a print head facing a platen is mounted on a carrier. The serial printer includes a carrier motor composed of a direct-current (DC) motor for driving the carrier and provides acceleration and deceleration control of the carrier motor and moves the carrier along the platen in the direction of main scanning, thereby printing line by line.

Specifically, to print one line, the carrier is accelerated by controlling the carrier motor on the basis of the acceleration data preset so that the carrier may reach a specific constant speed V0 by the time it has arrived at the print start position as shown in FIG. 14. After the carrier motor has reached the constant speed, the print head starts to print. After the printing has been done, the carrier is decelerated by controlling the carrier motor on the basis of the preset deceleration data and is stopped at a specific position. In this way, printing is done line by line repeatedly until one page of print has been completed.

Recently, there have been demands for printers capable of printing at higher speeds. To realize high-speed printing with a serial printer as described above, the constant speed V0, the speed of the carrier in printing, has to be increased.

As the constant speed V0 is made higher, the distance required for acceleration (the acceleration distance) and the distance required for deceleration (the deceleration distance) must be made longer. Because in a serial printer as described above, acceleration control must be completed and constant-speed control be in operation by the time the carrier has reached the print start position. Therefore, the moving range W of the carrier must be made so much longer, leading to the problem of making the printer larger. An attempt to accelerate and decelerate at a stretch in a short distance would cause damping and permit the speed of the carrier to fluctuate as shown in FIG. 15. As a result, the movement of the carrier would be slow in becoming stable and have an adverse effect on the result of printing, leading to, for example, the corruption of the printed image.

Although printing may be done during acceleration or deceleration control of the carrier, variations in the speed of the carrier caused by the occurrence of damping during acceleration or deceleration control can have an adverse effect on the result of printing, leading to, for example, the corruption of the printed image.

BRIEF SUMMARY OF THE INVENTION

The object of the present invention is to provide a serial printer capable of printing at high speed without lengthening the moving range of the carrier or degrading the quality of the result of printing, by suppressing the variation of the speed of the carrier during acceleration or deceleration control and enabling printing even during the suppression.

The foregoing object is accomplished by providing a serial printer apparatus comprising: a print head for printing on a medium according to a received character signal; carrier means on which the print head is provided and which runs the print head over an unprintable region and a printable region; and control means for monitoring the running speed of the carrier means and controlling the speed of the carrier means by accelerating or decelerating while suppressing the amount of fluctuation of the speed at least in the printable region.

With this configuration, the unprintable region can be set narrower because the print head is accelerated even in the printable region instead of accelerating the print head to a constant speed in the unprintable region and then printing at the constant speed in the printable region as in the prior art. Similarly, since deceleration of the print head are performed in the printable region too, it is possible to make the unprintable region more narrow. Moreover, the acceleration and deceleration of the print head are controlled so as to suppress it at least in the printable region, which prevents the quality of print from deteriorating due to extreme acceleration or deceleration. This makes it possible to provide a compact serial printer that ensures a constant quality of print.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Hereinafter, a wire dot printer according to a first embodiment of the present invention will be explained by reference to FIGS. 1 to 7.

Figure 1:
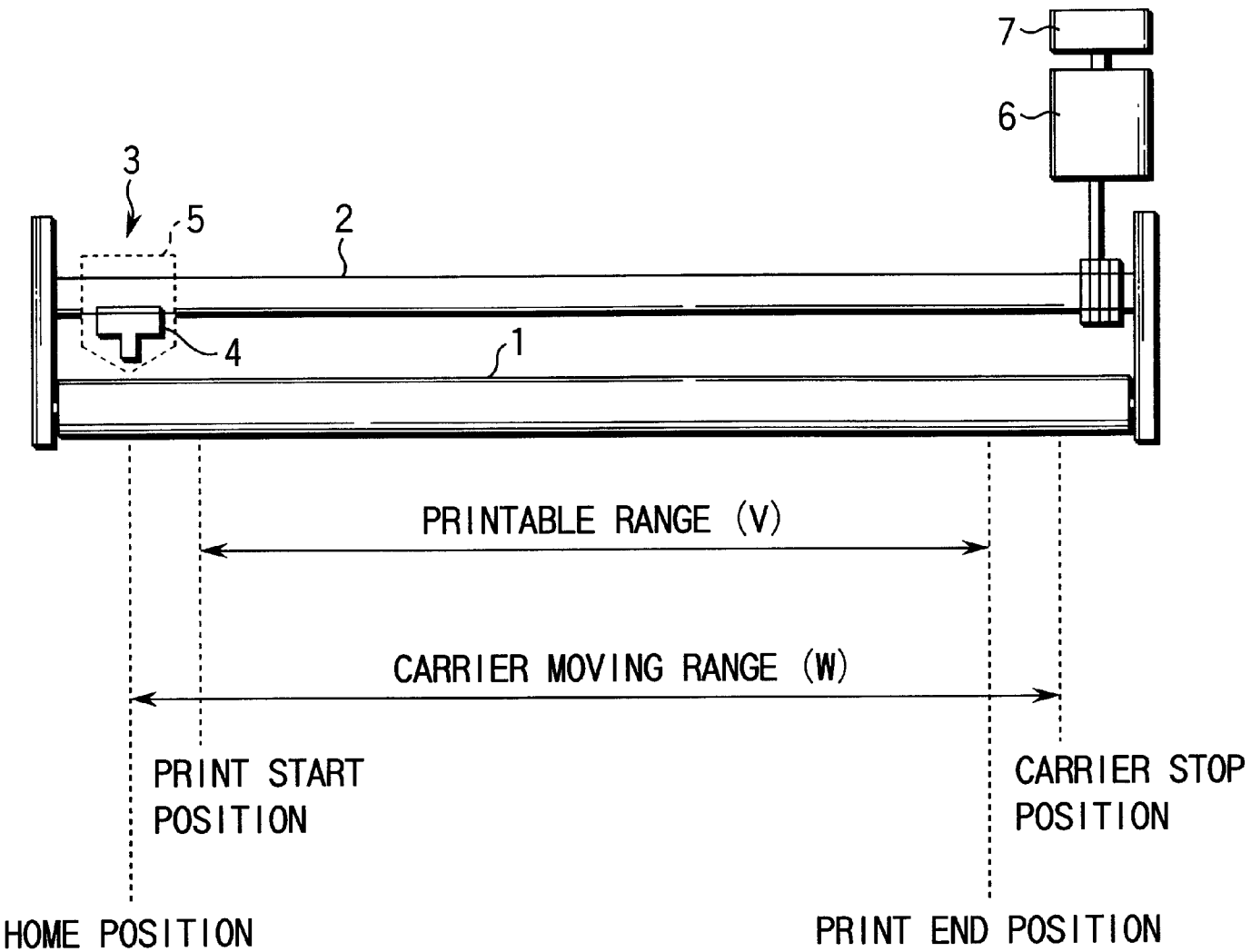
FIG. 1 is a diagram to help explain the configuration of the platen and its vicinities in a wire dot printer according to a first embodiment of the present invention.

FIG. 1 shows the configuration of a platen and its vicinities in the first embodiment. In FIG. 1, a platen 1 is pivotally supported at both its ends. A carrier shaft 2 is provided along the platen 1. A carrier 3 is provided on the carrier shaft in such a manner that it can move along the shaft in the direction of main scanning. The carrier 3 is provided with a print head 4 and an ink ribbon cassette 5. In the print head 4, holes through which the tips of wires can go in and out have been made. An ink ribbon in the ink ribbon cassette 5 is stretched in such a manner that it intervenes between the print head 4 and platen 1.

The carrier 3 is provided on a carrier belt (not shown) stretched along the carrier shaft 2. On one end of the carrier shaft 2, a carrier motor 6 functioning as carrier driving means is provided. The carrier motor 6 moves the carrier 3 by means of the carrier belt along the carrier axis 2.

The carrier motor 6 is composed of a direct-current (DC) servo motor. The carrier motor 6 is provided with an encoder 7 that generates pulses according to the rotation of the motor. A CPU, explained later, monitors the output pulse of the encoder 7, thereby sensing the position and varying speed of the carrier 3.

The encoder 7 is not necessarily provided on the carrier motor 6 and may be provided on an idle pulley. Instead, a linear encoder may be used which is provided in the direction in which the carrier 3 moves.

The carrier 3 is designed to be movable in the carrier moving range W from one end of the carrier shaft, the home position, to the other end in FIG. 1. Accordingly, in the carrier moving range, it is necessary to set a range where the print head 4 can print, that is, a printable range V (the range from the print start position to the print end position in FIG. 1). The position in the printable range at which printing output (dot output) is started differs according to the printing data.

Figure 2:
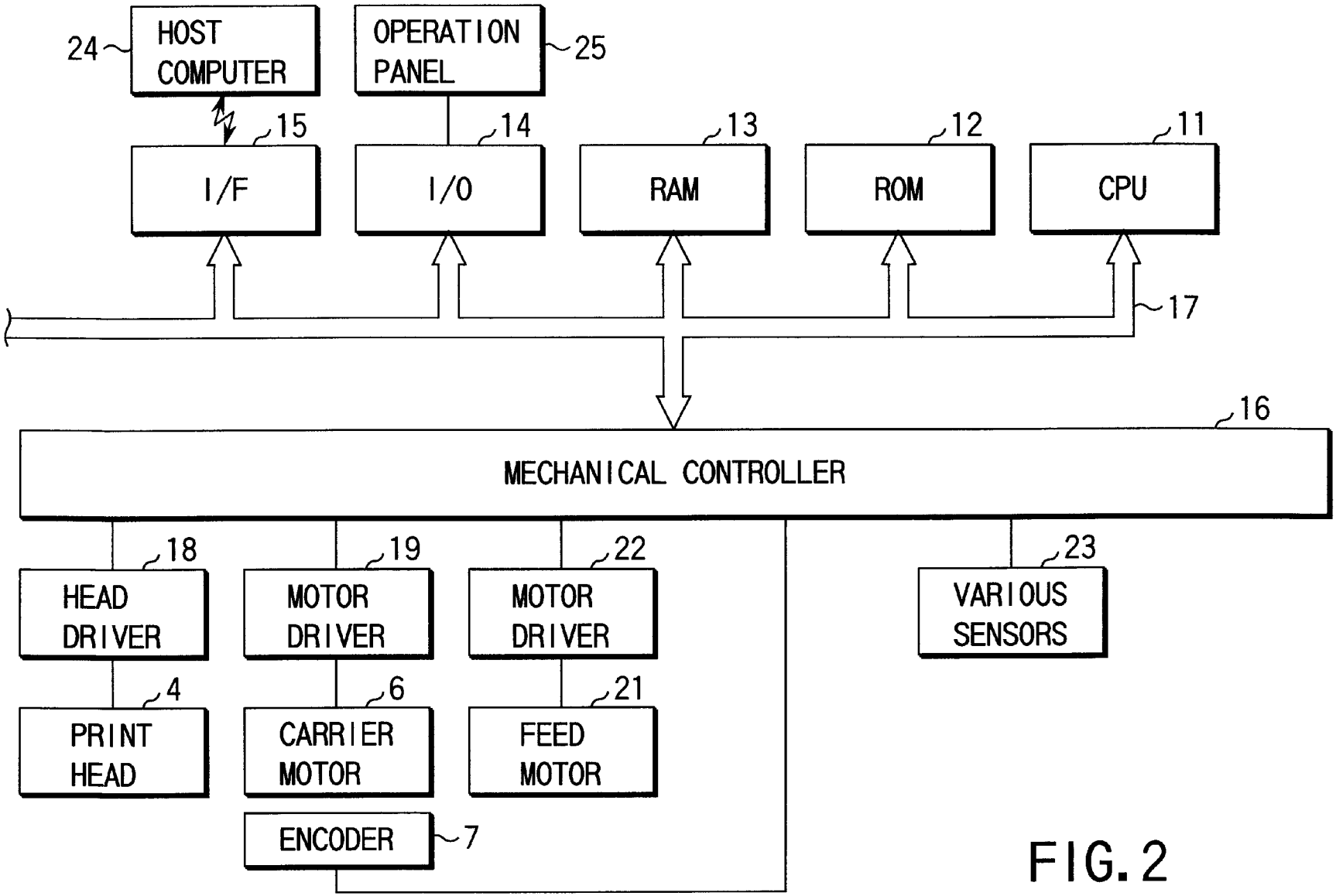
FIG. 2 is a block diagram illustrating the configuration of the wire dot printer of FIG. 1.

FIG. 2 is a block diagram illustrating the configuration of the wire dot printer in the first embodiment. The wire dot printer includes a CPU (central processing unit) 11 constituting the main part of the control section, a ROM (read-only memory) 12 in which programs and data required for the CPU 11 to control each section have been stored, a RAM (random access memory) 13 in which various memory areas for temporarily storing the data processed by the CPU 11 are to be stored, an I/O port 14, an interface (I/F) 15, and a mechanical controller 16. The CPU 11, ROM 12, RAM 13, I/O port 14, I/F 15, and mechanical controller 16 are connected to each other by means of bus lines 17 including an address bus, a data bus, and a control bus.

Connected to the mechanical controller 16 are a head driver 18 for driving the print head 4, a motor driver 19 for driving the carrier motor 6 that moves the carrier 3 along the carrier shaft 2, a motor driver 22 for driving a feed motor 21 that drives the platen 1 for feed, various sensors 23 including a sensor that senses the leading edge of a sheet of paper, and the encoder 7.

A host computer 24 is connected to the I/F 15 via a communication cable. An operation panel 25 is connected to the I/O port 14. With the operation panel 25, the operator performs various operations.

Figure 3A:
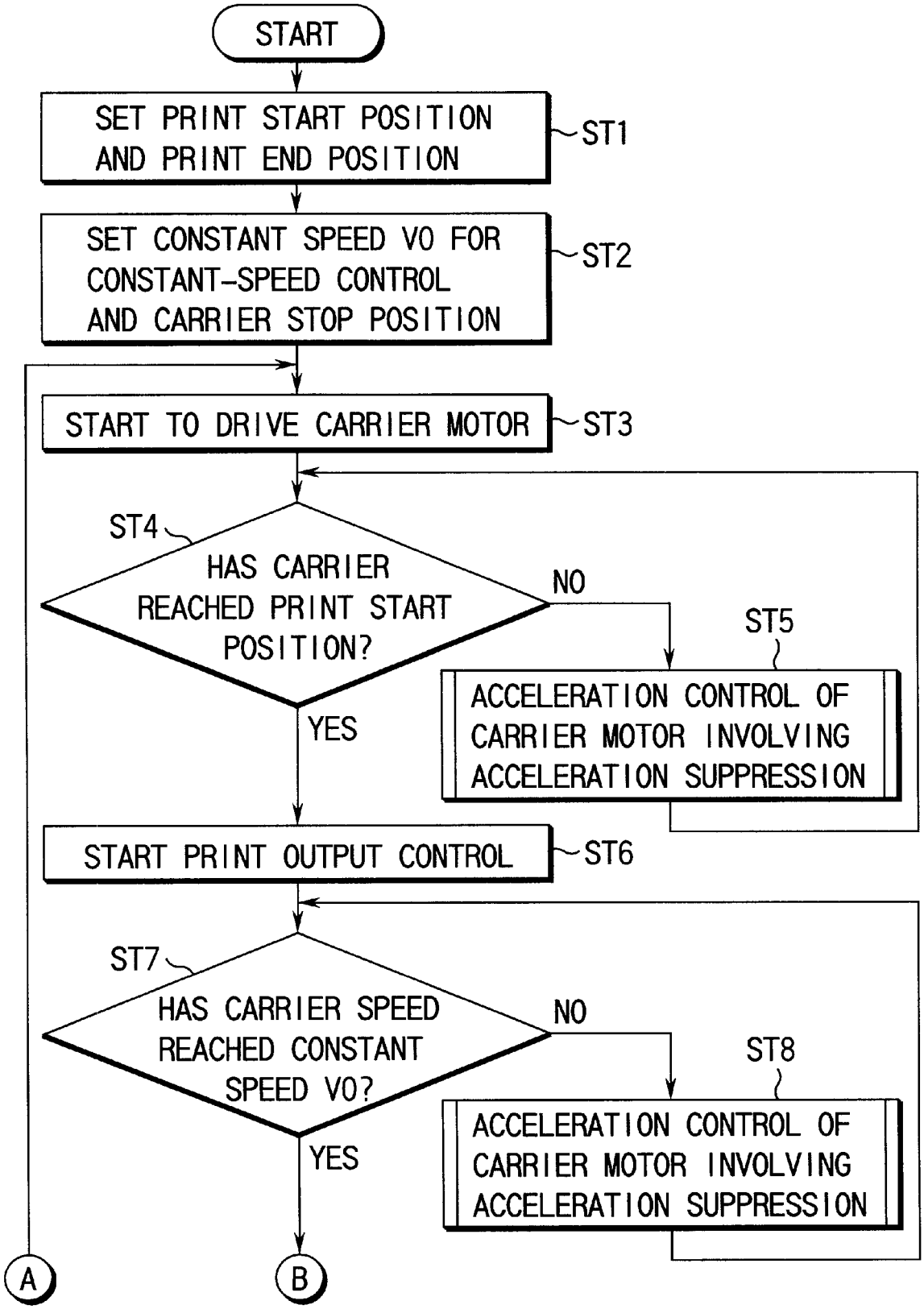
FIGS. 3A and 3B are flowcharts for printing control performed by the CPU of FIG. 1.
Figure 3B:
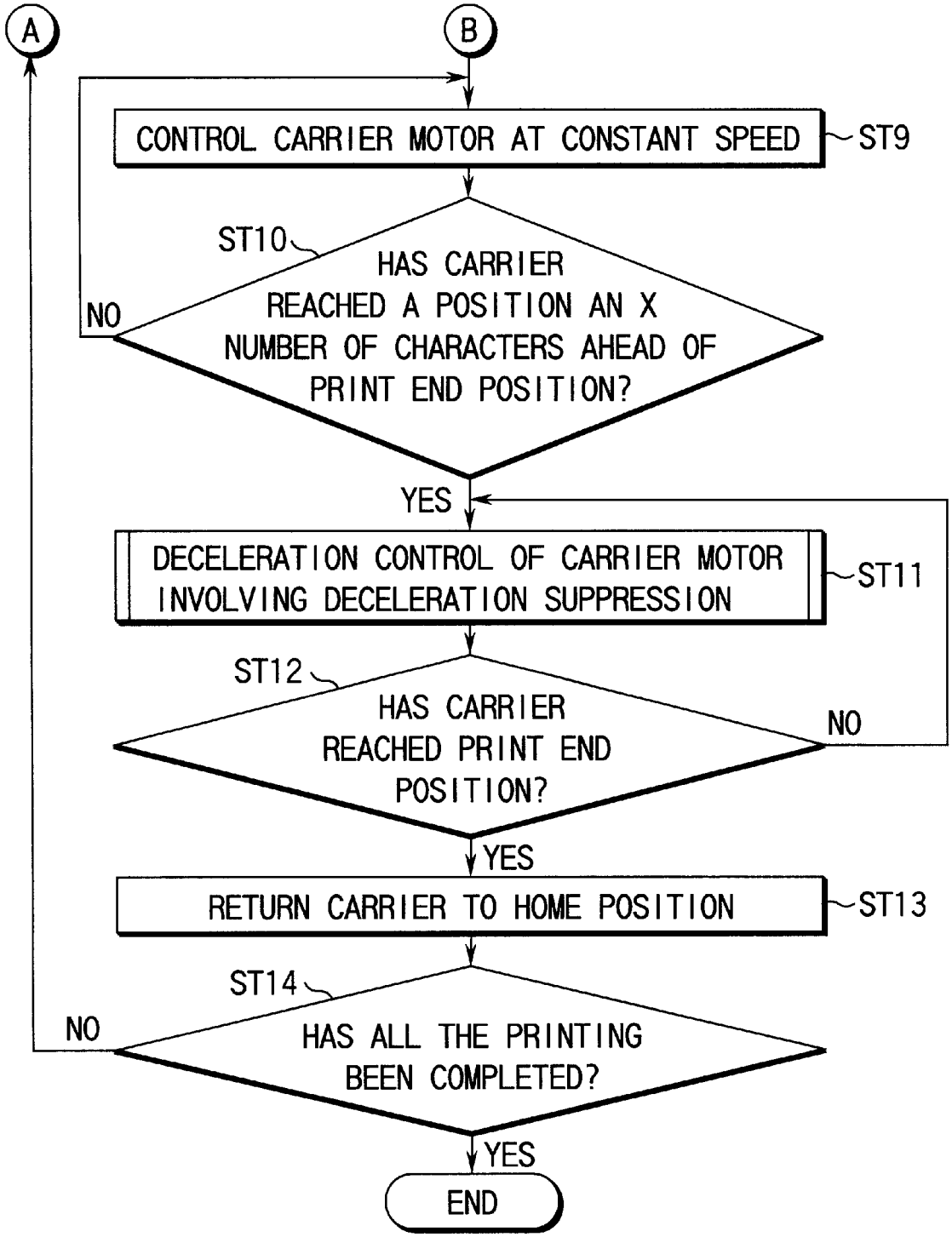

The CPU 11 performs printing control as shown in FIGS. 3A and 3B. The CPU 11 first sets a print start position and a print end position at step 1 (ST1). As a result, the printable range V shown in FIG. 1 is determined. Then, at step 2 (ST2), the CPU 11 sets a constant speed of V0 at which constant-speed control is performed and a carrier stop position. This determines the carrier moving range W shown in FIG. 1.

Next, at step 3 (ST3), the CPU 11 starts to drive the carrier motor 6 and judges on the basis of the output of the encoder 7 at step 4 (ST4) whether the carrier 3 has reached the print start position. If having judged at ST4 that the carrier 3 has not reached the print start position, the CPU 11 will perform acceleration control of the carrier motor 6 involving acceleration suppression at step 5 (ST5).

Figure 4:
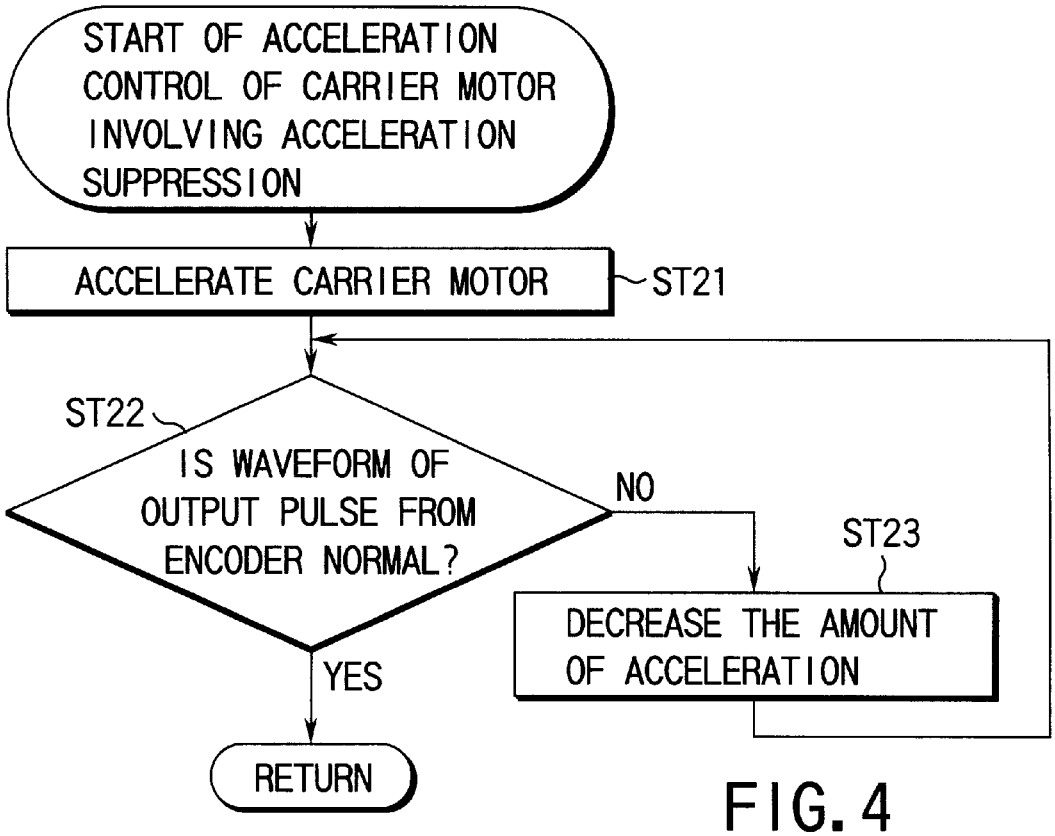
FIG. 4 is a flowchart for acceleration control of the carrier motor involving acceleration suppression shown in FIGS. 3A and 3B.

In acceleration control of the carrier motor 6 involving acceleration suppression, as shown in FIG. 4, the carrier motor 6 is accelerated at step 21 (ST21) by controlling the carrier motor 6 on the basis of the preset acceleration data. At step 22 (ST22), it is judged whether the waveform of the output pulse from the encoder 7 is normal (or changes smoothly with no damping). Specifically, it is judged whether the waveform is corrupted.

Figure 15:
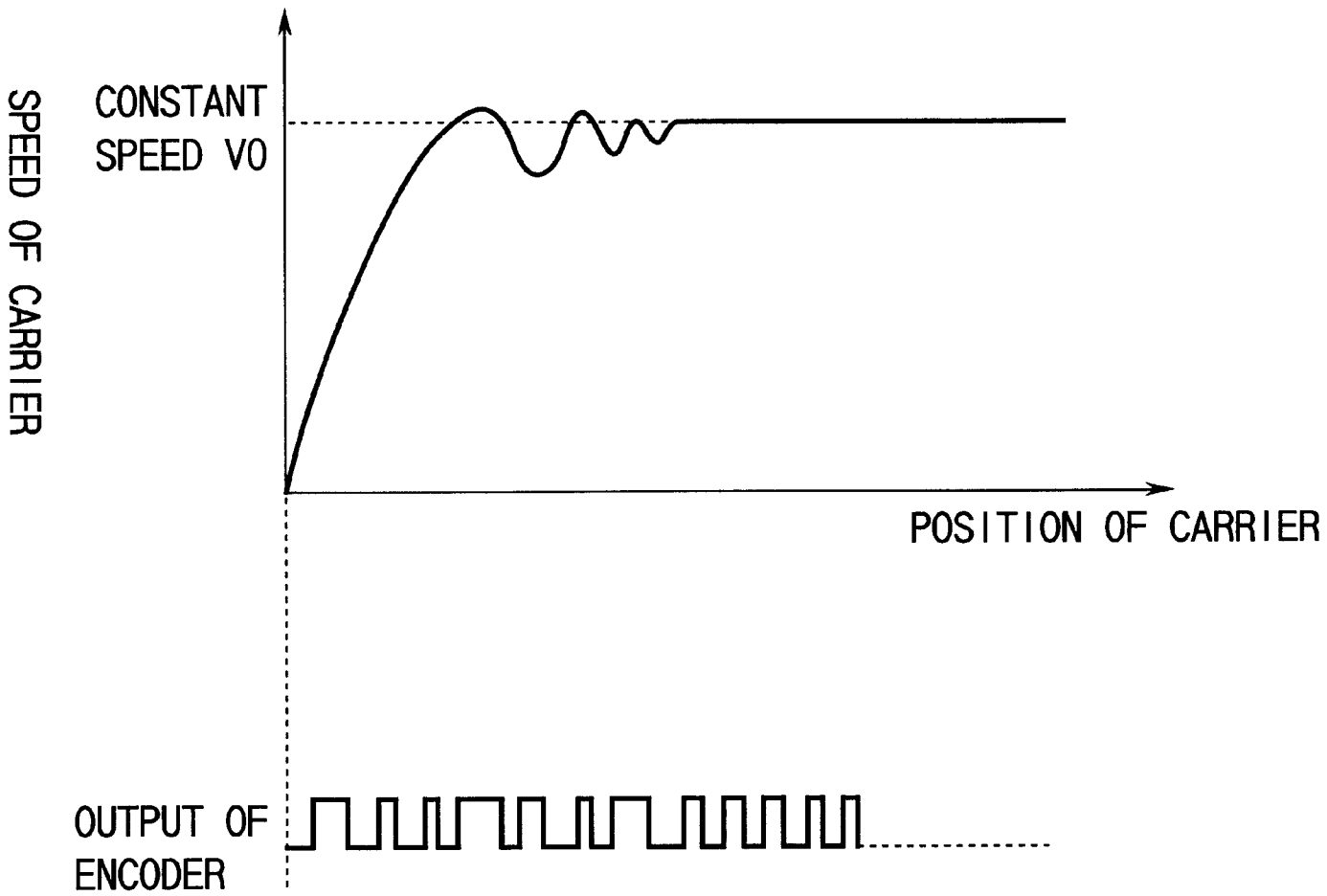
FIG. 15 shows the relationship between the speed of the carrier and the output pulse of the encoder when the speed of the carrier is increased in the conventional serial printer.

If the acceleration of the carrier motor 6 is smooth, the width of the output pulse from the encoder 7 will change gradually. If damping has occurred, the waveform of the output pulse from the encoder 7 will be corrupted in such a manner that, for example, the width of the pulse will become shorter or longer as shown in FIG. 15. Sensing the corruption of the pulse width determines whether the acceleration is stable or whether the speed of the carrier has fluctuated or damping has occurred. Specifically, in FIG. 6, if expression $X1>X2>X3>X4 \ldots >Xn$ is fulfilled, it will be judged that the waveform of the output pulse from the encoder 7 is normal (or that the speed of the carrier has not fluctuated). If the expression is not fulfilled, it will be judged that the waveform of the output pulse from the encoder 7 is not normal (or that the speed of the carrier has fluctuated).

Figure 6:
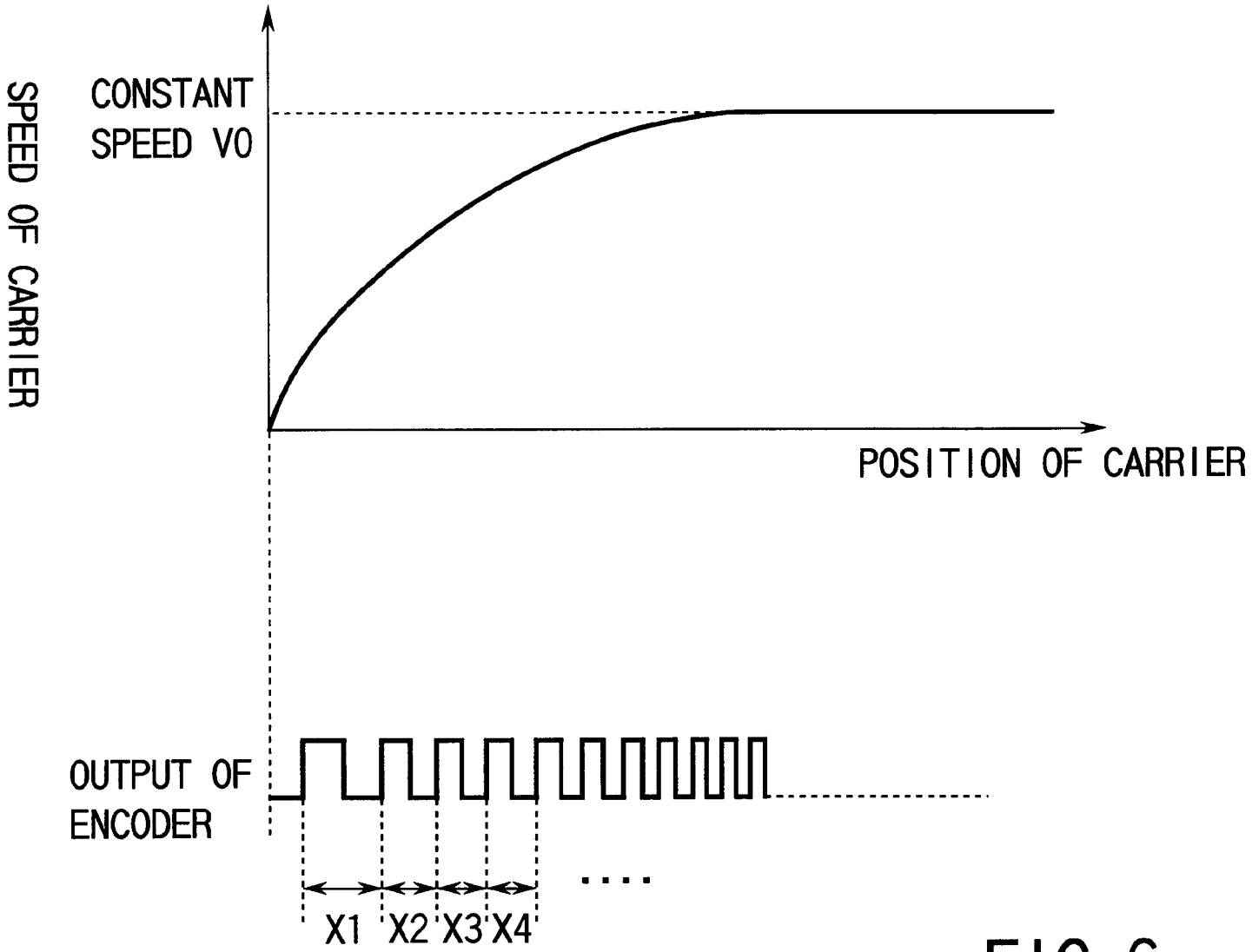
FIG. 6 shows the relationship between the speed of the carrier and the output pulse of the encoder in the first embodiment.

If it has been judged at ST22 that the waveform of the output pulse is not normal or that the speed of the carrier has fluctuated, the amount of acceleration of the carrier motor 6 will be decreased at step 23 (ST23) and control be returned to ST22. By doing this, stable acceleration control can be achieved as shown in FIG. 6 where the width of the output pulse from the encoder 7 becomes shorter gradually.

If it has been judged at ST22 that the output pulse from the encoder 7 is normal or that the speed of the carrier has not fluctuated, control will be returned to ST4 in FIGS. 3A and 3B.

If it has been judged at ST4 that the carrier 3 has reached the print start position, print output control will be started at ST6. Namely, one line of output will be printed on the basis of the printing data received from the host computer 24.

Next, it is judged at ST7 whether the speed of the carrier motor 6 has reached the constant speed V0. If it has been judged at ST7 that the constant speed has not been reached, acceleration control of the carrier motor 6 involving the acceleration suppression of FIG. 4 will be performed at ST8 and control will be returned to ST7. If it has been judged at ST7 that the constant speed V0 has been reached, constant-speed control of the carrier motor 6 will be performed at ST9 to maintain the constant speed V0.

Then, it is judged at ST10 whether the carrier 3 has reached a point a specific distance ahead of the print end position. This judgment is made to determine the timing with which deceleration is started. The judgment is needed to perform deceleration control before the completion of printing. Therefore, how much distance ahead of the print end position the deceleration control should be started must be determined on the basis of the distance that enables stable deceleration. As an example, it is judged whether the carrier 3 has reached a position an X number of characters ahead of the print end position.

If it has been judged at ST10 that the carrier 3 has not reached a position an X number of characters ahead of the print end position, control will be returned to ST9. If it has been judged at ST10 that the carrier 3 has reached a position an X number of characters ahead of the print end position, deceleration control of the carrier motor 6 involving deceleration suppression will be performed at ST11.

Figure 5:
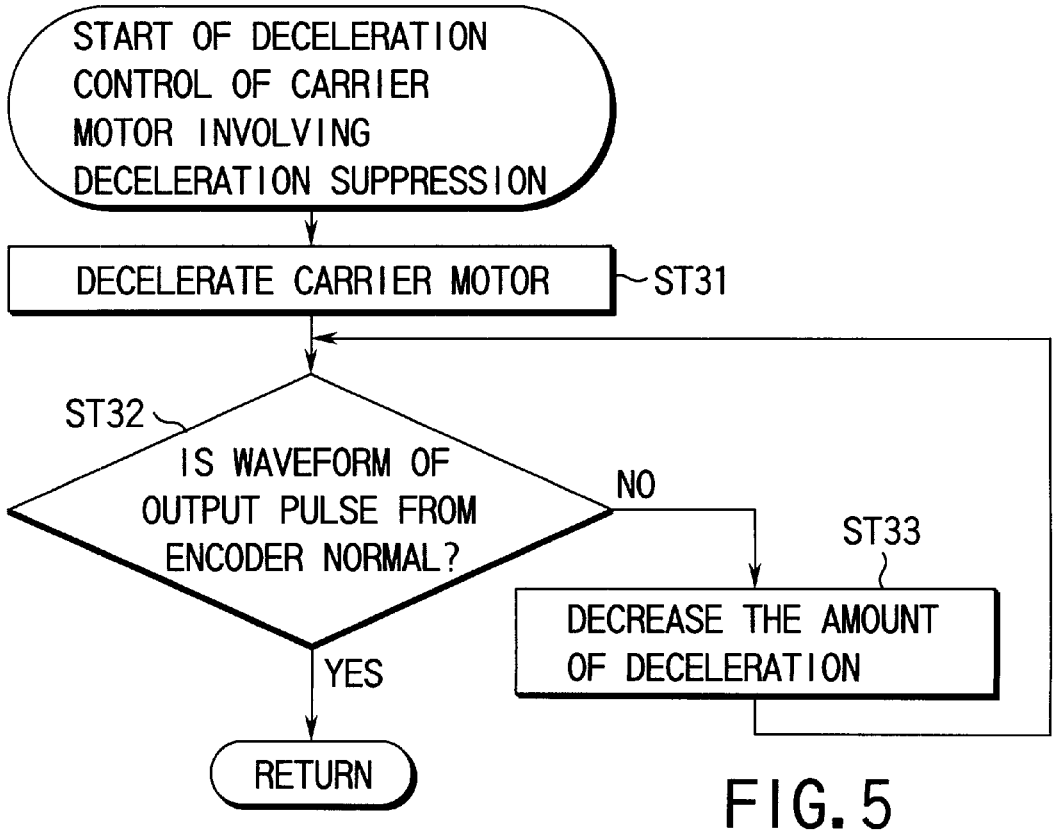
FIG. 5 is a flowchart for deceleration control of the carrier motor involving deceleration suppression of FIGS. 3A and 3B.

In deceleration control of the carrier motor 6 involving deceleration suppression, as shown in FIG. 5, the carrier motor 6 is decelerated by controlling the carrier motor 6 on the basis of the preset deceleration data at step 31 (ST31). As in acceleration control of the carrier motor 6, it is judged at step 32 (ST32) whether the waveform of the output pulse from the encoder 7 is normal (or the waveform changes smoothly with no damping). This determines whether the speed of the carrier has fluctuated or damping has occurred.

If it has been judged at ST32 that the waveform of the output pulse from the encoder 7 is not normal or that the speed of the carrier has fluctuated, the amount of deceleration of the carrier motor 6 will be decreased at step 33 (ST33) and control will be returned to ST32. By doing this, deceleration control is achieved stably while suppressing the fluctuation of the speed of the carrier. If it has been judged at ST32 that the waveform of the output pulse from the encoder 7 is normal or that the speed of the carrier has not fluctuated, control will be returned to ST12 in FIGS. 3A and 3B.

Specifically, it is judged at ST12 whether the carrier 3 has reached the carrier stop position. If it has been judged at ST12 that the carrier 3 has not reached the carrier stop position, control will be returned to ST11. If it has been judged at ST12 that the carrier 3 has reached the carrier stop position, reverse control of the carrier motor 6 will be performed at ST13 to return the carrier to the home position.

Then, it is judged at step 14 (ST14) whether all the printing has been done. If it has been judged at ST14 that all the printing has not been completed, control will be returned to ST3. If it has been judged at ST14 that all the printing has been completed, the printing control will be ended.

Figure 7:
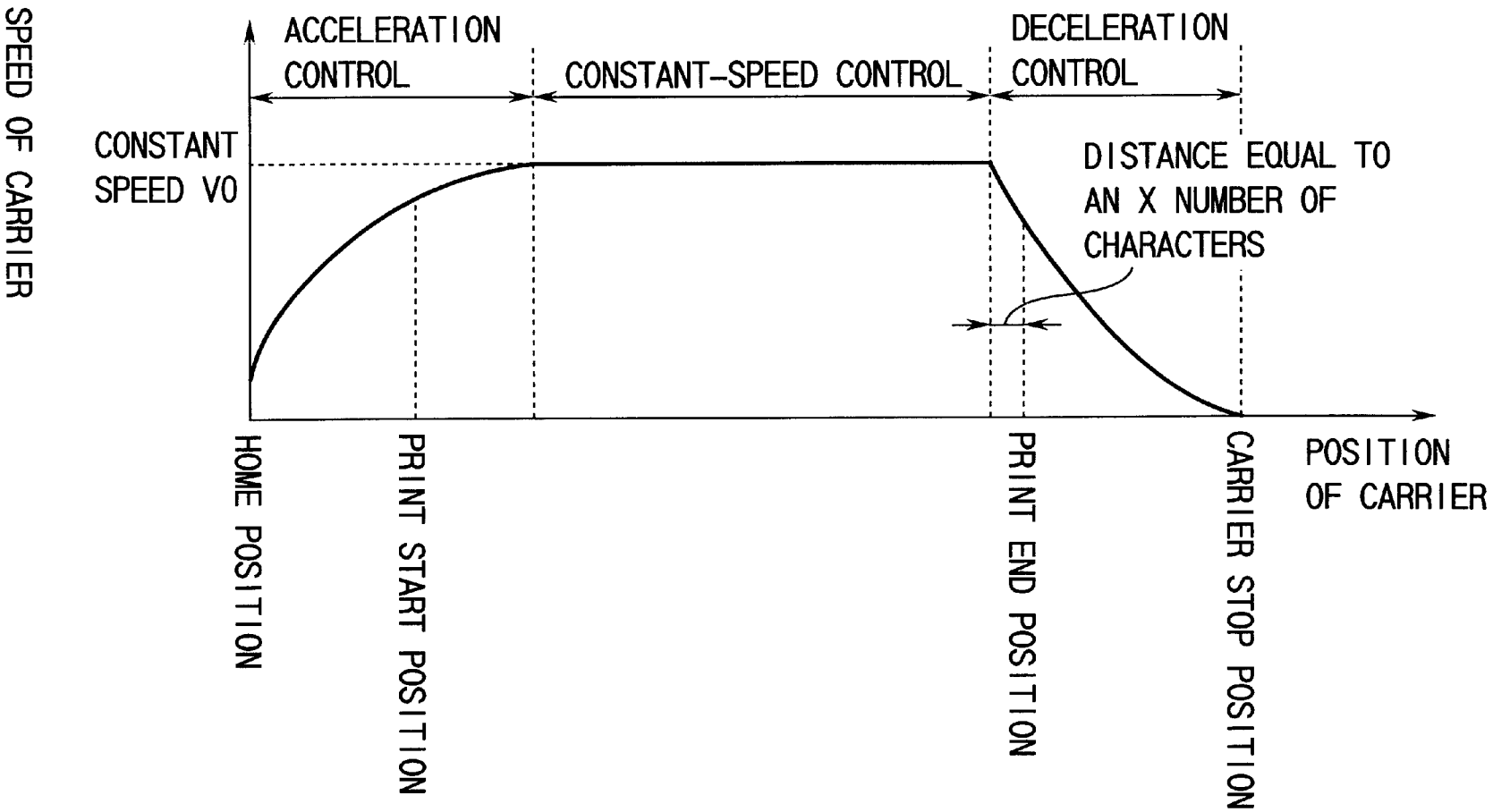
FIG. 7 shows the relationship between the print start position and print end position and the timing of speed control of the carrier in printing control in the first embodiment.

With the first embodiment constructed as described above, when one line is printed, the waveform of the output pulse from the encoder 7 is monitored in acceleration control of the carrier motor 6. If a fluctuation in the speed of the carrier, such as the corruption of the waveform, has been sensed, smooth acceleration of the carrier 3 will be maintained by reducing the amount of acceleration. At the same time, the carrier will be controlled so that it may reach a specific print start position in the direction of main scanning before the speed of the carrier reaches the constant speed V0 as shown in FIG. 7.

Consequently, the carrier can be brought into a print output enable state before the speed of the carrier has reached the constant speed V0, or in the course of acceleration control. This makes it possible to secure a sufficient distance needed for acceleration of the carrier 3 without lengthening the moving range of the carrier, even when printing is done at high speed. Because stable speed control is performed during acceleration control, even when printing is done during acceleration control, the printing can be effected at high speed without degrading the quality of the result of printing.

Even during deceleration control of the carrier motor 6, the waveform of the output pulse from the encoder 7 is monitored. If a fluctuation in the speed of the carrier, such as the corruption of the waveform, has been sensed, the amount of the deceleration will be decreased. This secures the smooth deceleration of the carrier 3 and brings the carrier into deceleration control before the carrier has reached the print end position (or when the carrier has reached a place an X number of characters ahead of the print end position) as shown in FIG. 7.

Therefore, the carrier 3 can be brought into the print output enable state even in the course of deceleration control. This makes it possible to secure a sufficient distance needed for deceleration of the carrier 3 without lengthening the moving range of the carrier, even when printing is done at high speed.

Because speed control is performed stably during deceleration control, even when printing is done during deceleration control, printing can be effected at high speed without degrading the result of printing.

With the first embodiment, because the moving range of the carrier 3 can be made shorter while securing the quality of printing, the entire size of the printer can be made smaller and its cost be reduced.

In the first embodiment, the present invention has been applied to one-side printing control. In one-side printing control, printing is done when the carrier moves forward, whereas printing is not effected when the carrier returns to the home position. The invention may be applied to two-way printing control in which printing is done not only when the carrier moves forward but also when it returns to the home position.

Furthermore, the present invention may be applied to not only a wire dot printer but also other general printers that print while moving the print head in the direction of main scanning, such as a thermal printer or an ink-jet printer.

Hereinafter, a wire dot printer according to a second embodiment of the present invention will be explained by reference to FIGS. 8A to 11. A diagram illustrating the configuration of the wire dot printer of the second embodiment and its vicinities and a block diagram of the wire dot printer are the same as those in FIGS. 1 and 2, so a detailed explanation of them will not be given.

Figure 11:
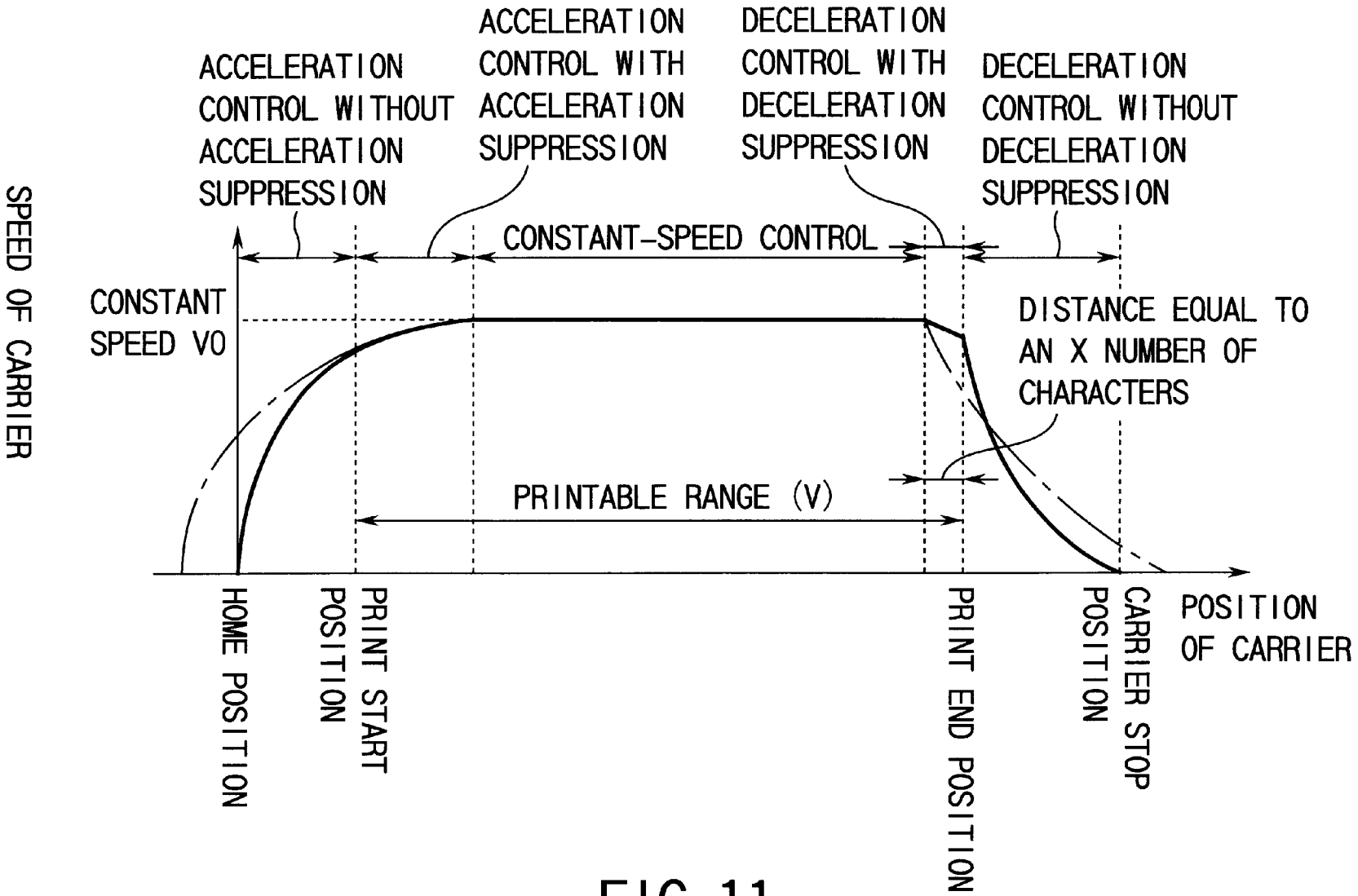
FIG. 11 shows the relationship between the print start position and print end position and the timing of speed control of the carrier in printing control in the second embodiment.

The second embodiment differs from the first embodiment in that acceleration suppression of the carrier 3 is performed during the time from when the carrier has entered the printable range V until it has reached the constant speed V0 as shown in FIG. 11. In contrast, in the first embodiment, acceleration control of the carrier 3 is performed during the time from when acceleration control of the carrier 3 has been started until the carrier has reached the constant speed V0.

Figure 8A:
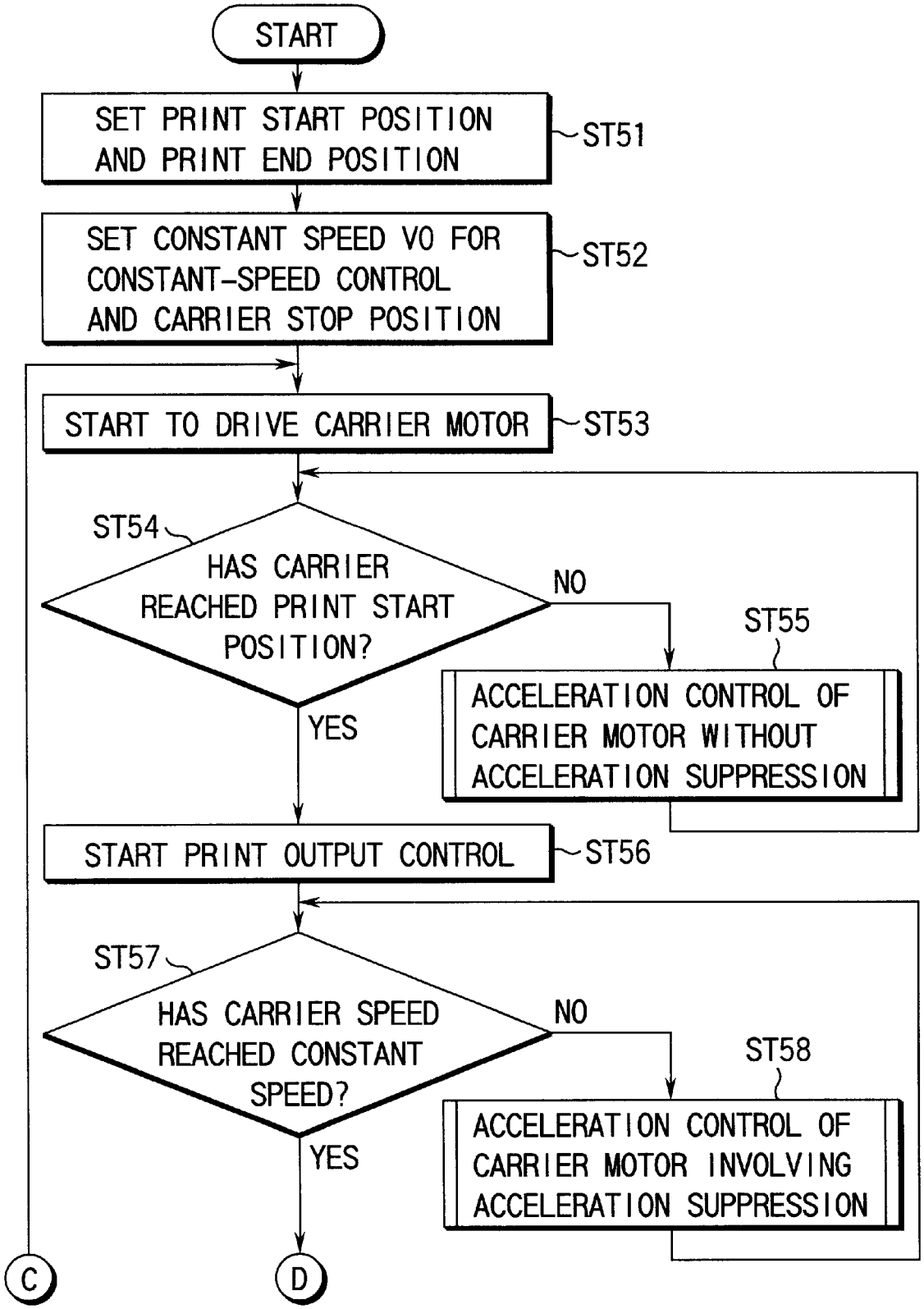
FIGS. 8A and 8B are flowcharts for printing control performed by a CPU in a second embodiment of the present invention.
Figure 8B:
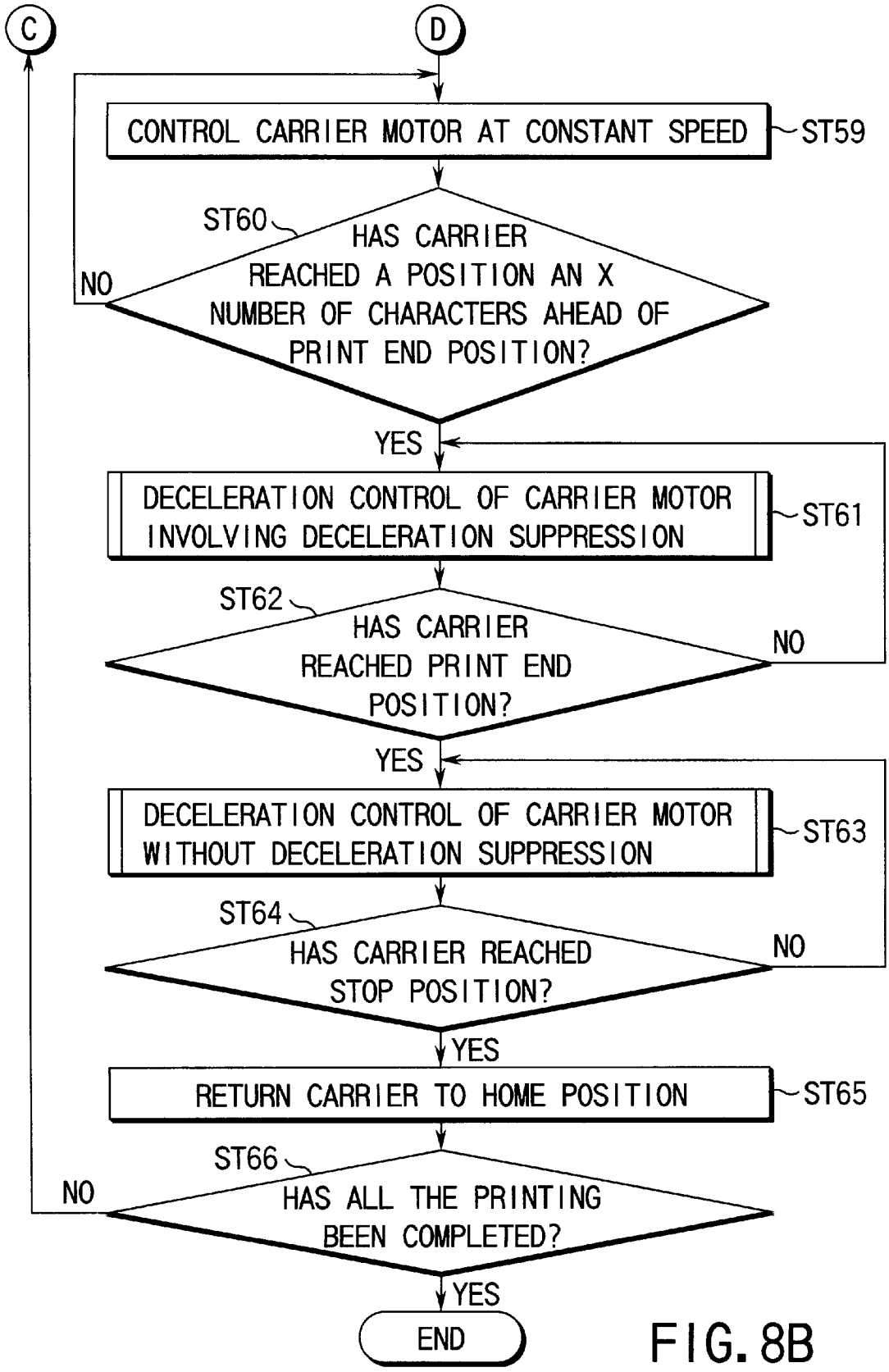

The CPU 11 of the second embodiment is designed to perform printing control as shown in FIGS. 8A and 8B. The processes at steps 51 (ST51) to 54 (ST54) of FIGS. 8A and 8B are the same as those at ST1 to ST4 of FIGS. 3A and 3B.

Figure 9:
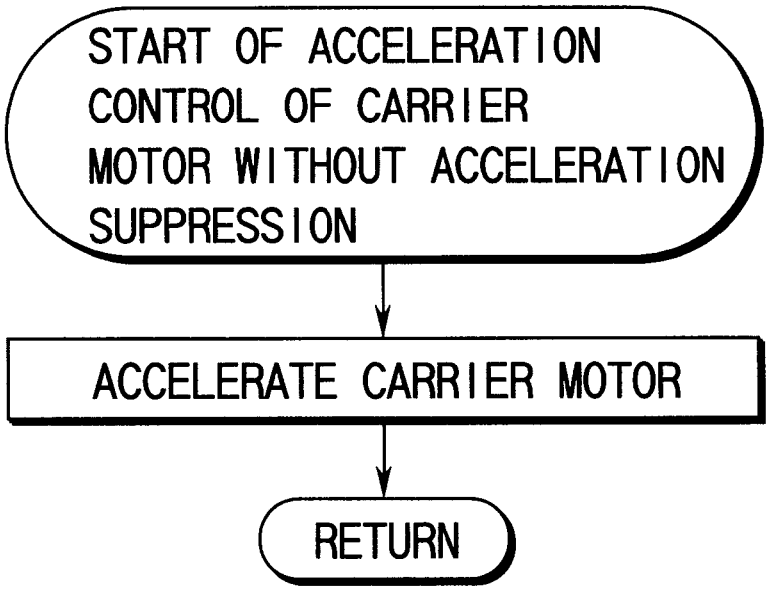
FIG. 9 is a flowchart for acceleration control of the carrier motor without acceleration suppression shown in FIGS. 8A and 8B.

If it has been judged at ST54 that the carrier 3 has not reached the print start position, acceleration control of the carrier motor 6 without acceleration suppression will be performed at ST55. That is, only acceleration control of the carrier motor 6 will be performed without monitoring a fluctuation in the speed of the carrier as shown in FIG. 9.

Because the carrier 3 has not entered the printable range V yet at this time, the presence or absence of a fluctuation in the speed of the carrier need not be considered. This makes it possible to set the acceleration data so that acceleration control may be performed in a shorter distance than in the first embodiment.

The processes at steps 56 (ST56) to 60 (ST60) are the same as those at ST6 to ST10 of FIGS. 3A and 3B.

The processes at step 58 (ST58) performs acceleration control of the carrier motor 6 with suppressing acceleration. That is the processes shown in FIG. 4 are performed.

If it has been judged at ST60 that the carrier 3 has reached a position an X number of characters ahead of the print start position, deceleration control of the carrier motor 6 involving deceleration suppression will be performed at step 61 (ST61). That is, the processes shown in FIG. 5 will be performed.

Figure 10:
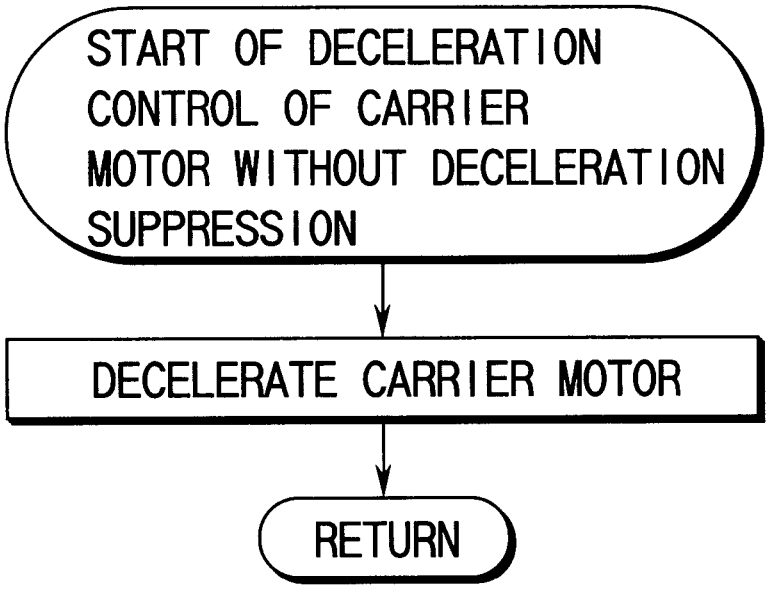
FIG. 10 is a flowchart for deceleration control of the carrier motor without deceleration suppression of FIGS. 8A and 8B.

Then, it is judged at step 62 (ST62) whether the carrier 3 has reached the print end position. If it has been judged at ST62 that the carrier 3 has not reached the print end position, control will be returned to ST61. If it has been judged at ST63 that the carrier 3 has reached the print end position, deceleration control of the carrier motor 6 without deceleration suppression will be performed at step 63 (ST63). That is, only deceleration control of the carrier motor 6 will be performed without monitoring a fluctuation in the speed of the carrier as shown in FIG. 10.

Because the carrier 3 has passed the printable range V, the presence or absence of a fluctuation in the speed of the carrier need not be considered. This makes it possible to set the deceleration data so that the carrier may be decelerated in a shorter distance than in the first embodiment.

Then, it is judged at step 64 (ST64) whether the carrier 3 has reached the print stop position. If it has been judged at ST64 that the carrier 3 has not reached the print stop position, control will be returned to the process at ST63. If it has been judged at ST64 that the carrier 3 has reached the print stop position, reverse control of the carrier motor 6 will be performed at step 65 (ST65) to return the carrier 3 to the home position.

With the second embodiment, as shown in FIG. 11, in acceleration control of the carrier 3, during the time from when the carrier 3 has started to be driven until the carrier 3 has entered the printable range V, acceleration control without acceleration suppression is performed. During the time from when the carrier has entered the printable range V until the carrier has reached the constant speed V0, acceleration control involving acceleration suppression is performed.

Before the carrier has reached the print start position, when the presence or absence of a fluctuation in the speed of the carrier need not be considered, the acceleration data can be set so that acceleration control may be performed in a shorter distance than in the first embodiment (shown by a dot-dash line in FIG. 11). This makes it possible to print at higher speed without degrading the quality of the result of printing and shorten the moving range W of the carrier.

In deceleration control of the carrier 3, too, deceleration with deceleration suppression is performed until the carrier 3 has passed the printable range V. After the carrier 3 has passed the printable range V, deceleration control without deceleration control is performed.

After the carrier has passed the print end position, when the presence or absence of a fluctuation in the speed of the carrier need not be considered, the deceleration data can be set so that deceleration control may be performed in a shorter distance than in the first embodiment. This makes it possible to print at higher speed without degrading the quality of the result of printing and shorten the moving range W of the carrier.

Next, a wire dot printer according to a third embodiment of the present invention will be explained by reference to FIGS. 12 and 13. A diagram illustrating the configuration of the wire dot printer of the third embodiment and its vicinities and a block diagram of the wire dot printer are the same as those in FIGS. 1 and 2, so a detailed explanation of them will not be given. The flowchart for printing control performed by the CPU 11 of the third embodiment is the same as that of FIGS. 8A and 8B in the second embodiment.

The third embodiment differs in printing control from the second embodiment in that at ST55, the carrier is accelerated at a stretch to a preset specific speed V1 lower than the constant speed V0 in acceleration control of the carrier motor 6 without acceleration suppression performed until the carrier has entered the printable range. In contrast, in the second embodiment, at ST55, only acceleration control of the carrier 3 is performed in acceleration control of the carrier motor 6 without acceleration control performed until the carrier has entered the printable range.

Figure 12:
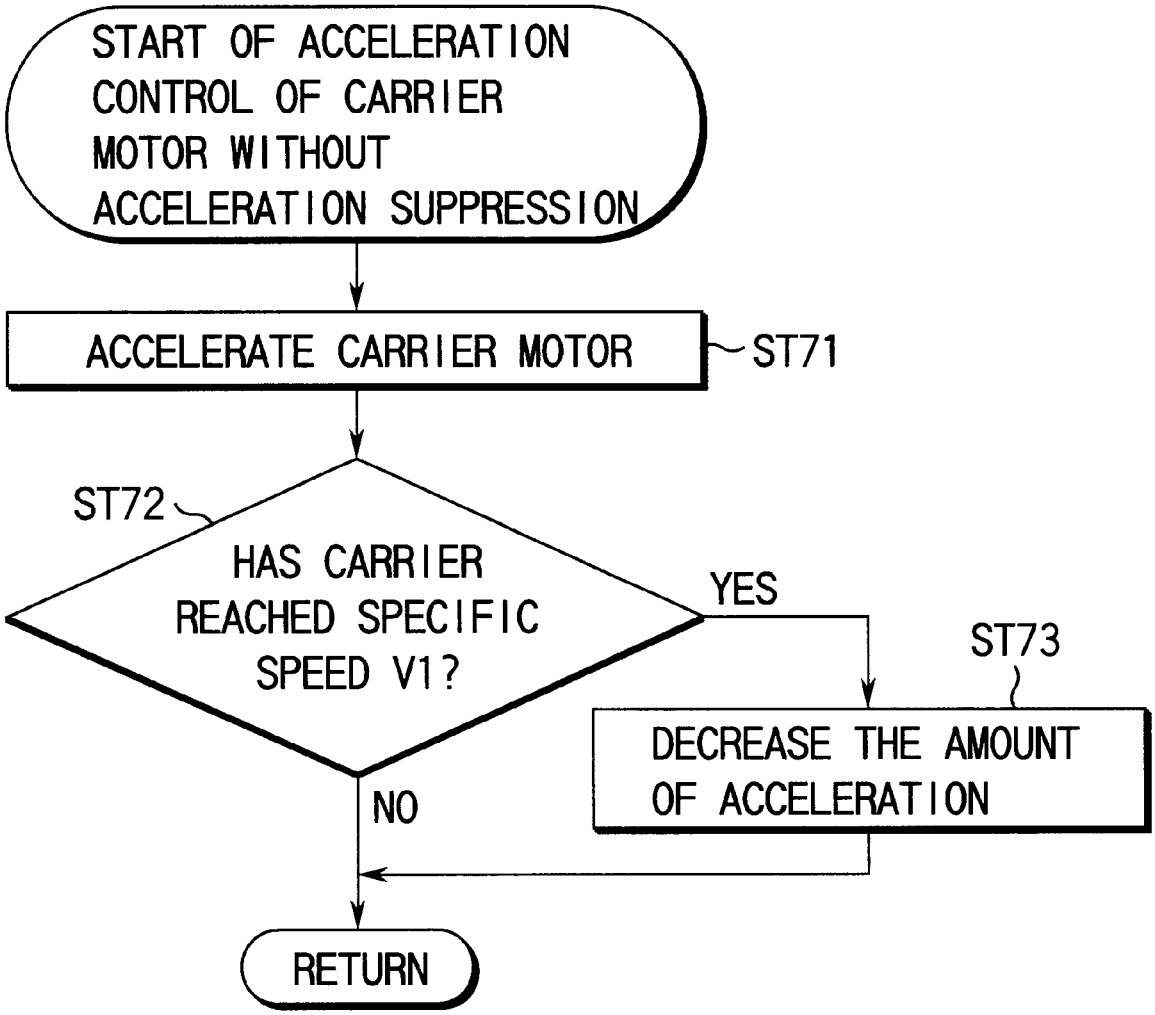
FIG. 12 is a flowchart for acceleration control of the carrier motor without acceleration suppression of FIGS. 8A and 8B in printing control performed by a CPU in a third embodiment of the present invention.
Figure 13:
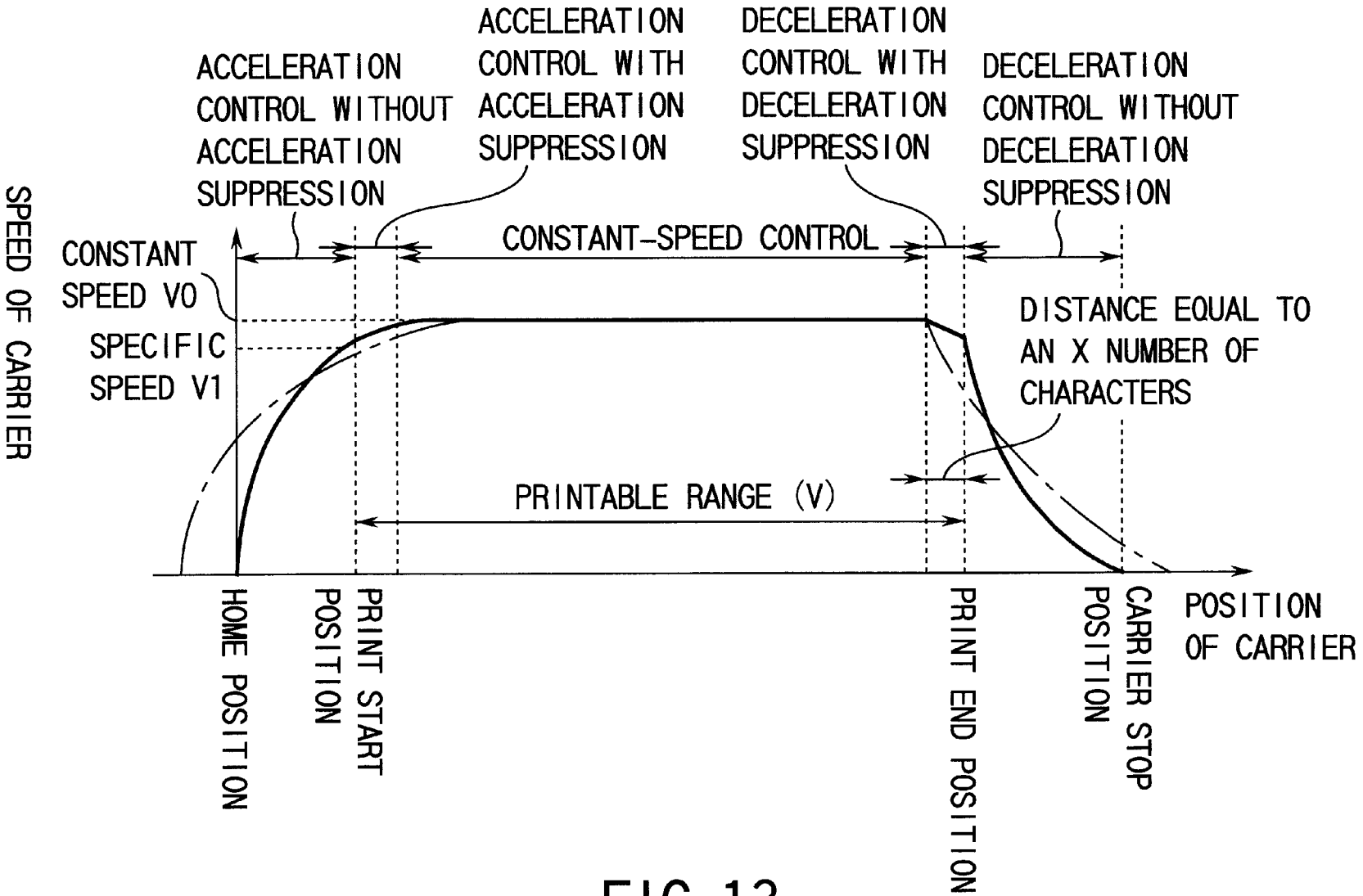
FIG. 13 shows the relationship between the print start position and print end position and the timing of speed control of the carrier in printing control in the third embodiment.
Figure 14:
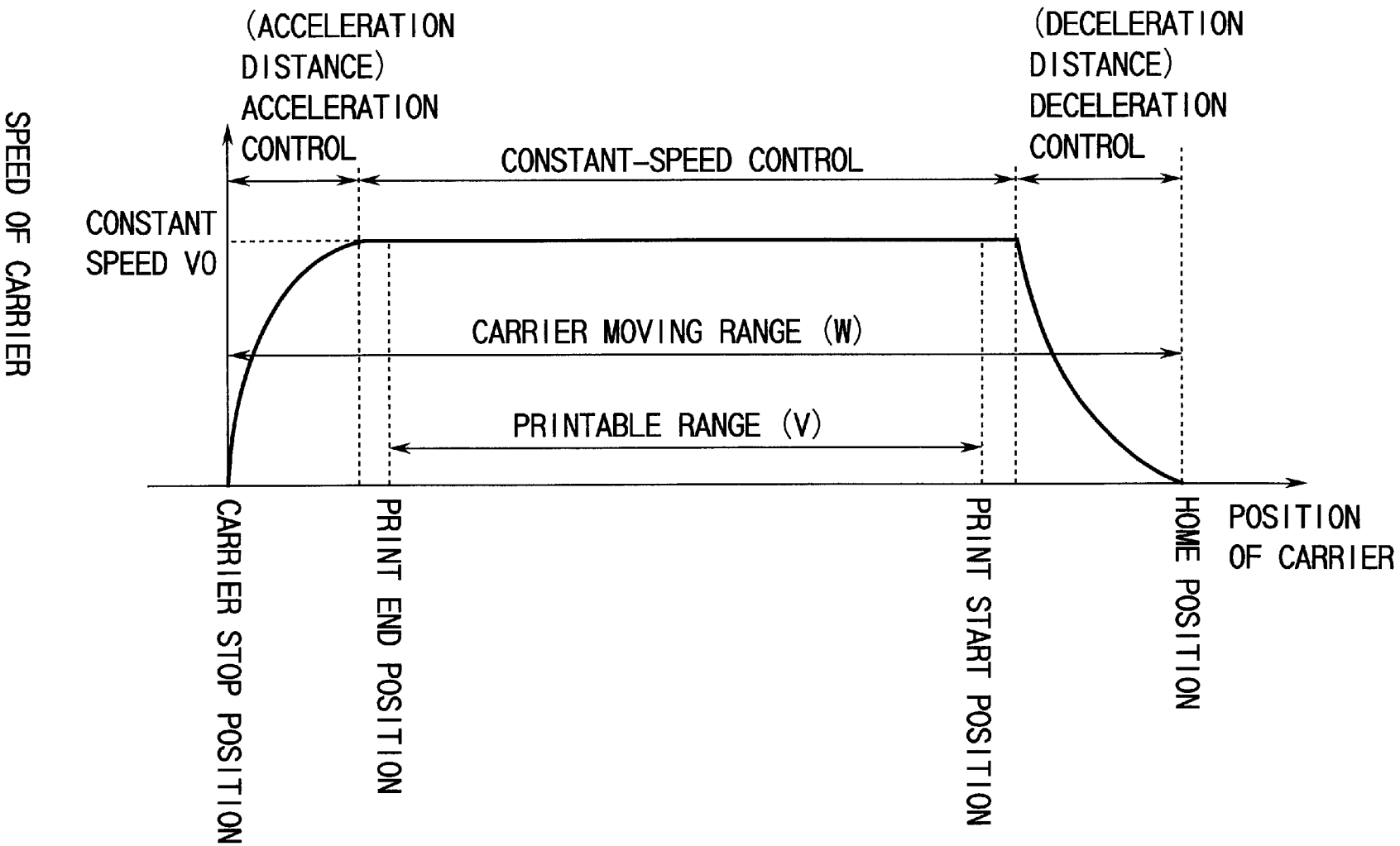
FIG. 14 shows the relationship between the print start position and print end position and the timing of speed control of the carrier in printing control in a conventional serial printer.

Specifically, in the third embodiment, if the CPU 11 has judged at ST54 in FIGS. 8A and 8B that the carrier 3 has not reached the print start position, it will perform acceleration control of the carrier motor 6 without acceleration suppression at ST54 as shown in FIG. 12. Namely, the carrier motor 6 is accelerated on the basis of the preset acceleration data at ST71. In this case, the acceleration data has only to be set so that the speed of the carrier may reach a specific speed V1 before the carrier reaches the print start position.

Then, it is judged at step 72 (ST72) whether the speed of the carrier has reached the specific speed V1. If it has been judged at ST72 that the speed of the carrier has not reached the specific speed V1, control will be returned to ST54. If it has been judged at ST72 that the speed of the carrier has reached the specific speed V1, the amount of acceleration will be reduced at step 73 (ST73) so that the acceleration of the carrier 3 may enter the printable range V more stably and control will be returned to ST54 in FIGS. 8A and 8B.

As described above, the speed of the carrier is accelerated at a stretch to the specific speed V1 preset lower than the constant speed V0, which brings the carrier 3 to the speed V1 faster than in the second embodiment before it has reached the print start position, when the presence or absence of a fluctuation in the speed of the carrier need not be considered. Therefore, the acceleration data can be set so that acceleration control may be performed in a shorter distance than in the second embodiment. This makes it possible to print at much higher speed without degrading the quality of the result of printing and make the carrier moving range W still shorter.

Furthermore, the speed of the carrier can be brought to the constant speed V0 faster than in the second embodiment by bringing the carrier 3 to the still faster speed V1 before the carrier has reached the print start position, when the presence or absence of a fluctuation in the speed of the carrier need not be considered. This makes it possible to shorten the distance required for acceleration control without acceleration suppression in FIG. 11 and prevent the distance for constant-speed control to keep the constant speed V0 from becoming shorter.

As described in detain, with the present invention, it is possible to provide a serial printer capable of printing at high speed without lengthening the carrier moving range or degrading the quality of the result of printing and of making the entire system smaller.

Furthermore, in acceleration control of the carrier, acceleration control with acceleration suppression is performed during the time from when the carrier has entered the printable range V until the speed of the carrier has reached the constant speed V0. Therefore, the acceleration data can be set so that acceleration control may be performed in a shorter distance before the carrier has reached the print start position, when the presence or absence of a fluctuation in the speed of the carrier need not be considered. This makes it possible to print at still higher speed without degrading the quality of the result of printing and shorten the carrier moving range W.

Furthermore, in deceleration control of the carrier, deceleration control with deceleration suppression is performed until the carrier has passed the printable range V. Therefore, the deceleration data can be set so that deceleration control may be performed in a shorter distance after the carrier has passed the print end position, when the presence or absence of a fluctuation in the speed of the carrier need not be considered. This makes it possible to print at still higher speed without degrading the quality of the result of printing and shorten the carrier moving range W.

Moreover, the speed of the carrier can be brought to a constant speed still faster by bringing the carrier to a still faster speed before the carrier has reached the print start position, when the presence or absence of a fluctuation in the speed of the carrier need not be considered. This prevents the distance needed for constant-speed control to keep the constant speed from becoming shorter.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A serial printer apparatus comprising:

a print head for printing on a medium according to a received character signal;

a carrier for carrying the print head over an unprintable region in which the print head cannot print on the medium and a printable region in which the print head can print on the medium; and control means for:

accelerating a running speed of the carrier when the running speed of the carrier is below a predetermined speed;

decreasing the running speed of the carrier in a suppressed manner when damping of the carrier is detected by monitoring the running speed of the carrier, and controlling the print head to print on the medium while the running speed of the carrier is being accelerated.

2. A serial printer apparatus comprising:

a print head for printing on a medium according to a received character signal;

a carrier for carrying the print head over an unprintable region in which the print head cannot print on the medium and a printable region in which the print head can print on the medium; and control means for:

decelerating a running speed of the carrier when the carrier reaches a position separated by a predetermined distance from a print end position, decreasing the running speed of the carrier in a suppressed manner when damping of the carrier is detected by monitoring the running speed of the carrier, and controlling the print head to print on the medium while the running speed of the carrier is being decelerated.

3. The serial printer apparatus according to claim 1, wherein the control means comprises means for:

suppressing the acceleration of the running speed of the carrier such that the acceleration is decreased when the carrier accelerates and the damping of the carrier is detected, accelerating the carrier in both the unprintable region and the printable region, and maintaining the running speed of the carrier once the carrier reaches a constant speed.

4. The serial printer apparatus according to claim 2, wherein the control means comprises means for:

suppressing the deceleration of the running speed of the carrier such that the deceleration is decreased when the carrier decelerates from a constant speed and the damping of the carrier is detected, and decelerating the carrier in both the unprintable region and the printable region.

5. The serial printer apparatus according to claim 1, wherein the control means comprises means for:

accelerating the carrier in an unsuppressed manner in the unprintable region and in the suppressed manner in the printable region, and maintaining the running speed of the carrier once the carrier reaches a constant speed.

6. The serial printer apparatus according to claim 2, wherein the control means comprises means for:

decelerating the carrier in the suppressed manner in the printable region and in an unsuppressed manner in the unprintable region to stop the carrier.

7. The serial printer apparatus according to claim 1, wherein the control means comprises means for:

accelerating the carrier in an unsuppressed manner in the unprintable region until the carrier reaches a preset speed and in the suppressed manner after the carrier reaches the predetermined speed, and accelerating the carrier in the suppressed manner in the printable region, and maintaining the running speed of the carrier once the carrier reaches a constant speed.

8. The serial printer apparatus according to claim 2, wherein the control means comprises means for:

monitoring the speed of the carrier based on a pulse outputted from an encoder sharing a same axis with a carrier motor that drives the carrier, and controlling the running speed of the carrier so as to suppress an amount of fluctuation of the running speed at least in the printable region.

* * * * *

UNITED STATES PATENT AND TRADEMARK OFFICE

CERTIFICATE OF CORRECTION

PATENT NO. : 6,139,205
DATED : October 31, 2000
INVENTOR(S) : Suzuki et al.

It is certified that error appears in the above-identified patent and that said Letters Patent is hereby corrected as shown below:

Title page,
Item [75] Inventors, lines 1-3, change to read as follows: -- Hisao Suzuki, Hiromoto Ishii, Akira Oda all of Mishima, Japan; Eiichi Furuya, Tagata-gun, Japan --.

Signed and Sealed this

Second Day of October, 2001

*Attest:*

Nicholas P. Godici

NICHOLAS P. GODICI

*Attesting Officer*

*Acting Director of the United States Patent and Trademark Office*